US007762863B1

(12) United States Patent
Lund et al.

(10) Patent No.: US 7,762,863 B1
(45) Date of Patent: Jul. 27, 2010

(54) PLUSH CHARACTERS

(75) Inventors: Bruce D. Lund, River Forest, IL (US); Paul N. Paulson, Evanston, IL (US); Michael D. Starrick, Maywood, IL (US)

(73) Assignee: Lund and Company, Chicago, IL (US)

( * ) Notice: Subject to any disclaimer, the term of this patent is extended or adjusted under 35 U.S.C. 154(b) by 281 days.

(21) Appl. No.: 11/927,188

(22) Filed: Oct. 29, 2007

Related U.S. Application Data

(63) Continuation-in-part of application No. 11/532,839, filed on Sep. 18, 2006.

(51) Int. Cl.
*A63H 30/00* (2006.01)

(52) U.S. Cl. ..... 446/175; 446/330; 446/353; 446/485

(58) Field of Classification Search ..... None
See application file for complete search history.

(56) References Cited

U.S. PATENT DOCUMENTS 6,506,095 B1 * 1/2003 Lund et al. ..... 446/353
6,645,036 B1 * 11/2003 Lund et al. ..... 446/355
6,672,935 B1 * 1/2004 Lund et al. ..... 446/330
6,736,693 B1 * 5/2004 Lund et al. ..... 446/354
6,746,301 B1 * 6/2004 Lund et al. ..... 446/298

* cited by examiner

*Primary Examiner*—Ronald Laneau
*Assistant Examiner*—Tramar Harper

(57) ABSTRACT

There are illustrated and claimed three versions of toy characters that are programmed to go through various sequences of movements such as sitting, lying down, rotating on a support accomplished by the movements of the body and leg assemblies as determined by a microprocessor. The three characters include various rib and block assemblies to provide for the desired programmed movements.

4 Claims, 18 Drawing Sheets

Fig. 7A
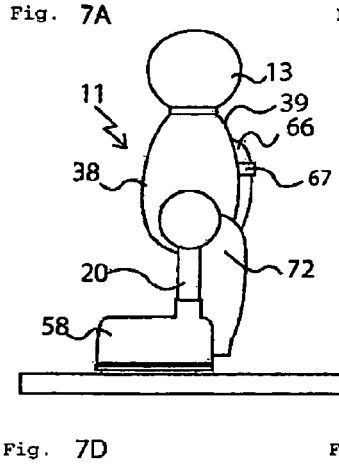
Fig. 7B
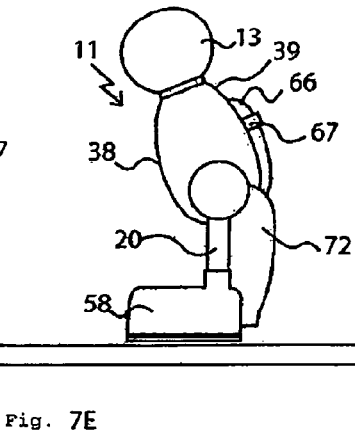
Fig. 7C
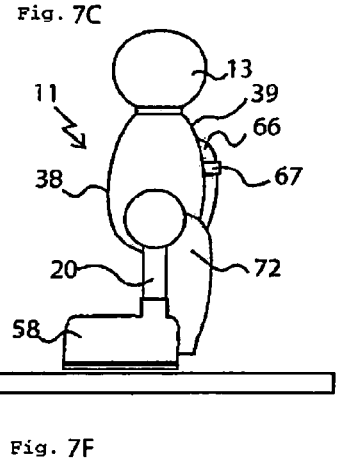
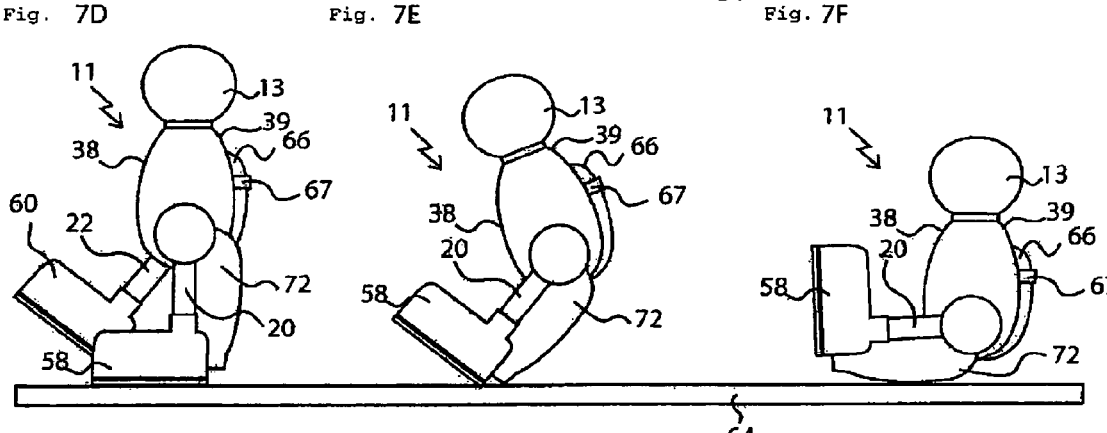
Fig. 7D
Fig. 7E
Fig. 7F
Fig. 7G
Fig. 7H
Fig. 7I
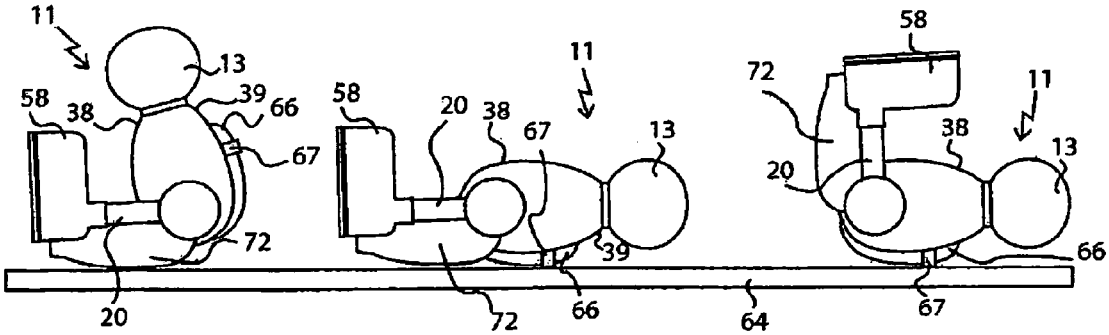

Fig. 10A
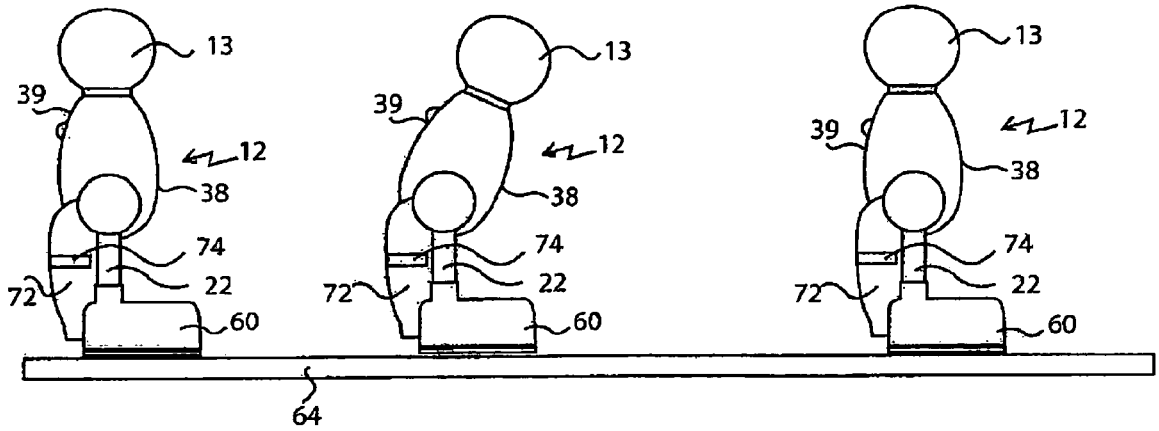
Fig. 10B
Fig. 10C
Fig. 10D
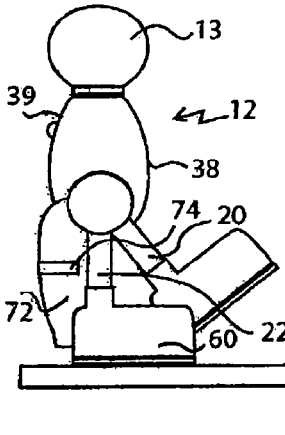
Fig. 10E
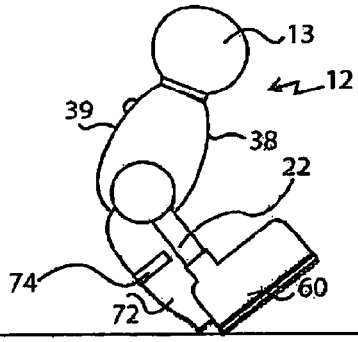
Fig. 10F
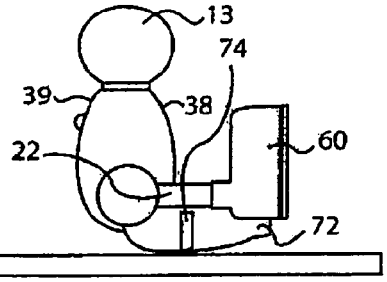
Fig. 10G
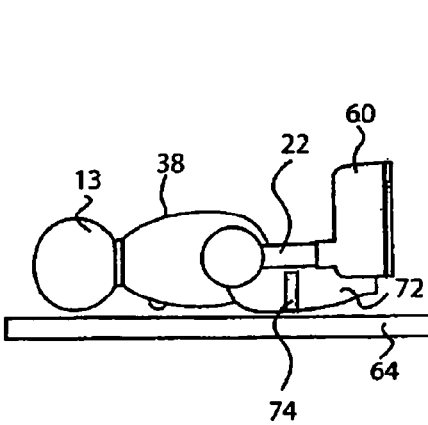
Fig. 10H
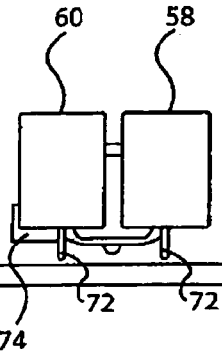
Fig. 10I
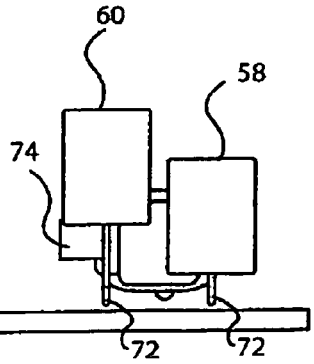

Fig. 10Va
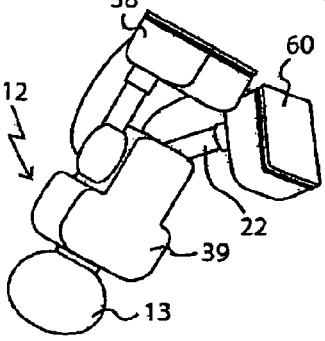
Fig. 10Wa
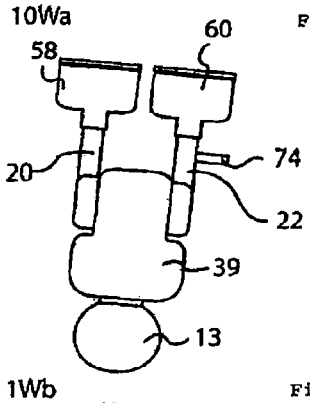
Fig. 10Xa
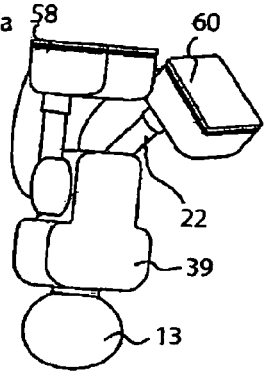
Fig. 1Vb
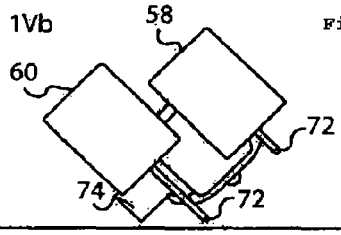
Fig. 1Wb
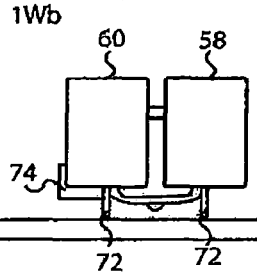
Fig. 1Xb
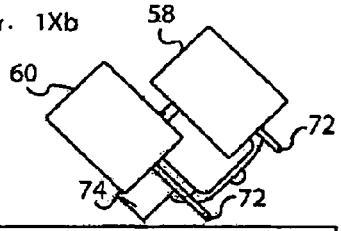
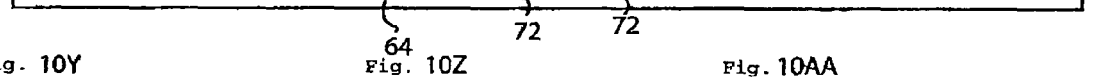
Fig. 10Y
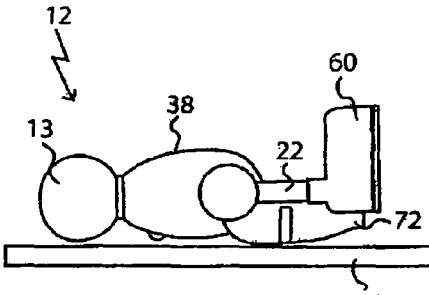
Fig. 10Z
Fig. 10AA
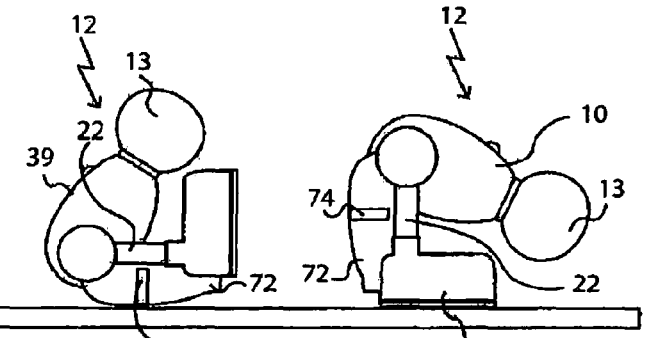
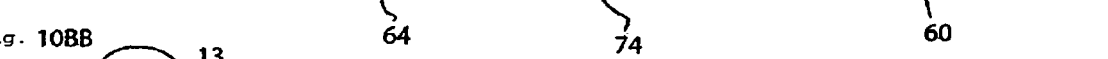
Fig. 10BB
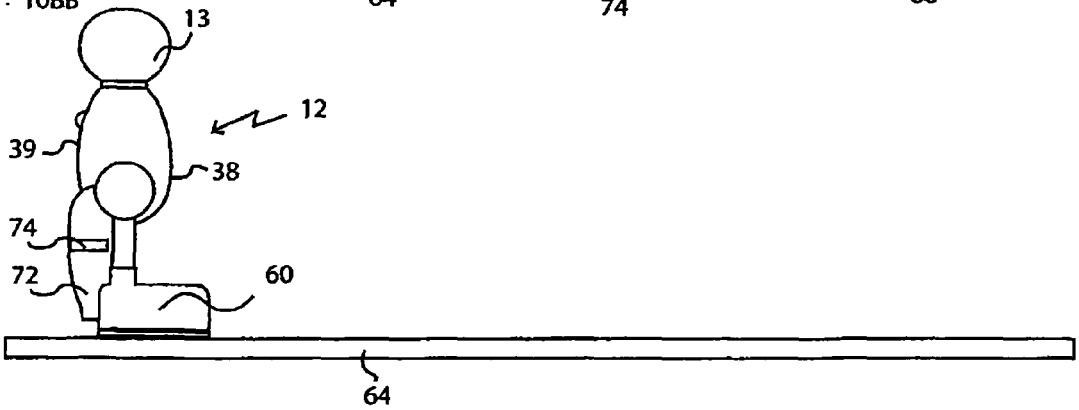

PLUSH CHARACTERS

This application is a continuation-in-part application of application Ser. No. 11/532,839 filed Sep. 18, 2006 and entitled Mechanical Plush Character.

Toy dolls or animals that perform various functions such as walking, talking, sitting, standing, lying on their back, rolling over, etc. are very popular with young children. They must be relatively inexpensive, attractive and simple to operate. Such toys serve as a continuous source of enjoyment and comfort.

There is herein described and illustrated several toy characters that are programmed and designed to go through a series of motor operated actions. This is accomplished by a single motor for moving the torso and legs of the character to effectuate sitting, wobbling, standing and various prone positions. The actions are suitably controlled by a microprocessor motor controller that is battery operated. To accomplish the various movements desired there is provided a bi-directional motor for controlling the leg and torso movements. The legs are pivotally connected to the torso and are interconnected by a teeter-totter mechanism that is designed so that both legs can move forwardly to bring about a sitting action or be moved, in opposite directions or when desired to assist in walking, standing, rolling over, etc. There is a controlled movement so the character can wobble, sit down, roll over, stand up and other sequenced controlled movements that bring joy and entertainment to its owner.

While the three illustrated embodiments are quite similar, they each contain several distinctive features to provide differing motions as will be described in detail with respect to each figure.

There are also provided suitable audio messages that emanate from a speaker when certain actions occur as regulated by the microprocessor.

BRIEF DESCRIPTION OF THE DRAWINGS

The details and operation of the three embodiments of the toy characters will be clear from the following drawings and the descriptions thereof in which:

FIGS. 4P-4DD illustrate another sequence of views wherein Elmo moves from a sitting position to a prone position then a rollover position and back to a standing position. At its various positions, it is programmed to perform additional functions.

FIGS. 7A-7H are a sequence of views showing Cookie moving from the standing position to a sitting position and then to a supine position.

FIGS. 7I-7M are a sequence of views showing Cookie moving around, back to a supine position and back to a sitting position.

FIGS. 10A-10F are a sequence of views wherein Ernie moves from a standing to a sitting position.

FIGS. 10G-10K are a sequence of views wherein Ernie moves from lying on its back to lying on its stomach.

FIGS. 10Va-10Xb are a sequence of views wherein the body and leg portions are moved through various positions and the toy character is rotated parallel to the ground a total of approximately 50 degrees.

FIGS. 10Y-10Bb are a sequence of views showing the toy character moved from its back prone position to a standing upright position.

DETAILED DESCRIPTION OF THE DRAWINGS

Figure 1:
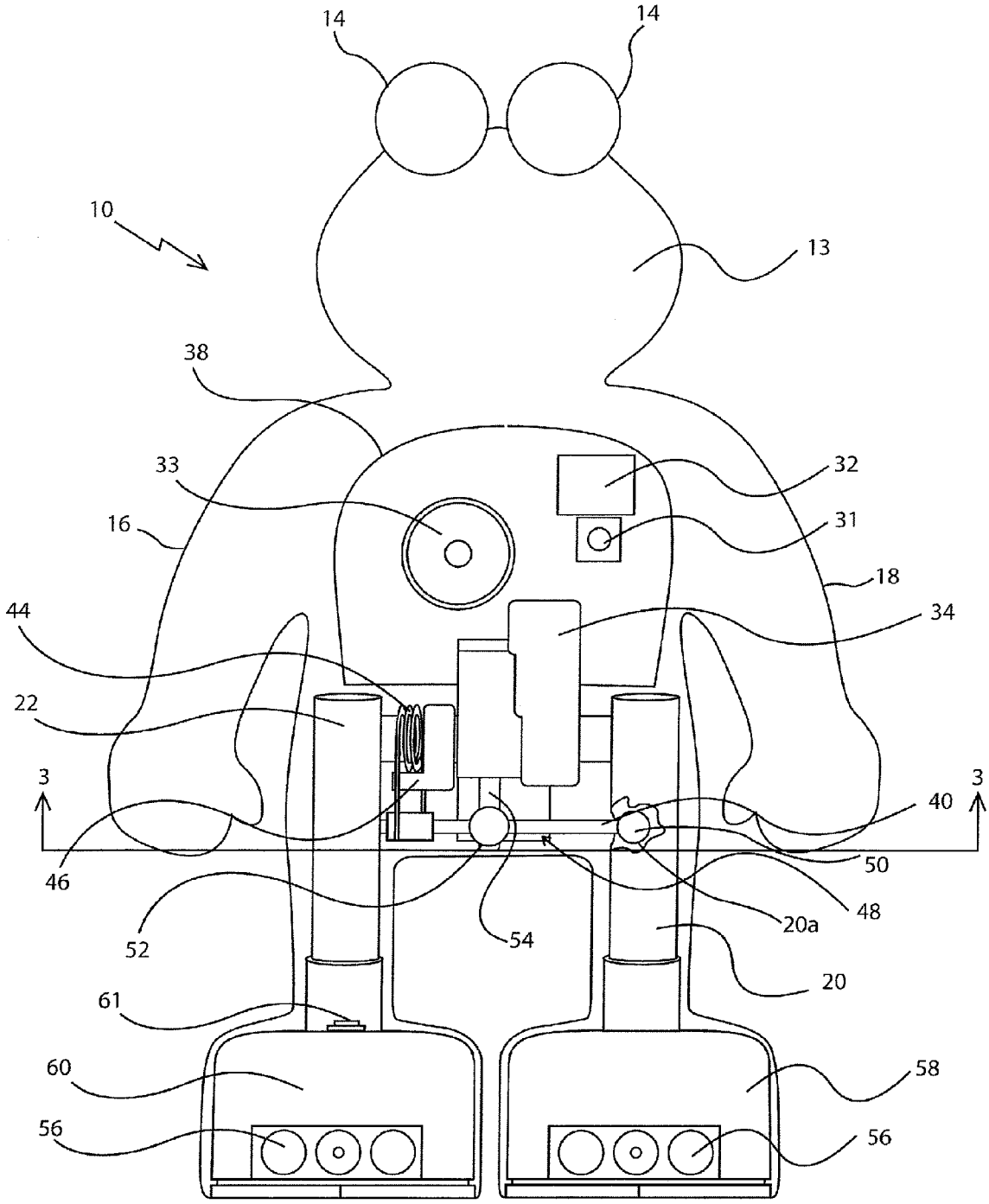
FIG. 1 is a cross-sectional view showing the internal components of a first toy plush character, which for ease of description will be referred to as Elmo.

Referring first to FIG. 1 there is illustrated the mechanisms that bring about the various moving modes of the Elmo toy plush character 10.

The Elmo plush character 10 includes a head portion 13 having plastic eyes 14, arms 16, 18, legs 20, 22 and attached feet 58, 60. There is also provided a front activation switch 31. A speaker 33 is also provided that is secured to a housing or torso 38. The switch 31 activates a microprocessor motor controller 32 that regulates the reversible motor mechanism 34 to effectuate the desired movements of the legs, 20, 22 and torso housing 38 and sounds emanating from the speaker 33. A switch is suitably provided to turn the power off and on (not shown).

The legs 20, 22 are pivotally hinged to the torso housing 38. Leg 20 and torso housing 38 are directly driven by the reversible motor mechanism 34.

Figure 3:
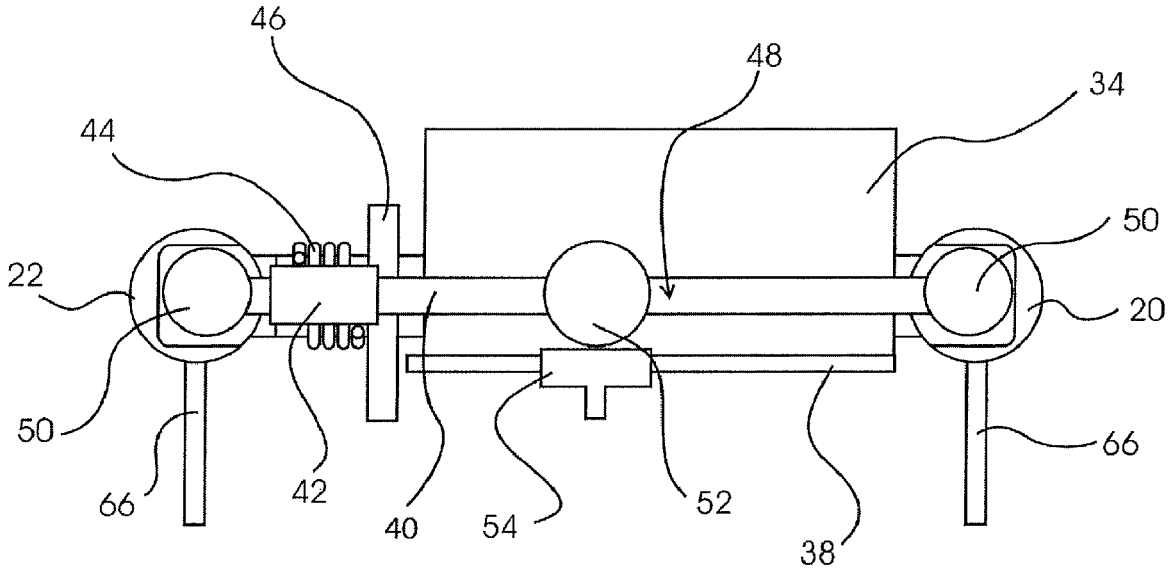
FIG. 3 is a bottom cross sectional view of the teeter-totter mechanism of the character at line 3A-3A of FIG. 1 which is identical in the three illustrated embodiments.

As shown more specifically in FIG. 3, the leg 22 is moved in the same direction as the directly driven leg 20 through the action of a rod 40 having a spring contact cylinder 42 that engages the end of a torsion spring 44.

The rod 40 is part of a teeter-totter linkage 48 and has balls 50 connected to the ends thereof which balls 50 fit into the circular recesses 20A and 22A (not shown) formed in their respective legs 20, 22. The teeter-totter effect is accomplished by a central pivot 52 that engages a pivot stop 54 secured to the housing 38 when the leg 20 is moved in a rearward direction. When leg 20 moves in a forward direction the central pivot 52 moves away from the pivot stop 54 and a teeter-totter action does not occur with the result that both legs 20, 22 move forward together.

It remains to note that the power to the microprocessor and motor are powered by batteries 56 in the feet 58, 60. An optional activator switch 61 is located on the top of the right foot 60, whose function will be described hereinafter.

Figure 2:
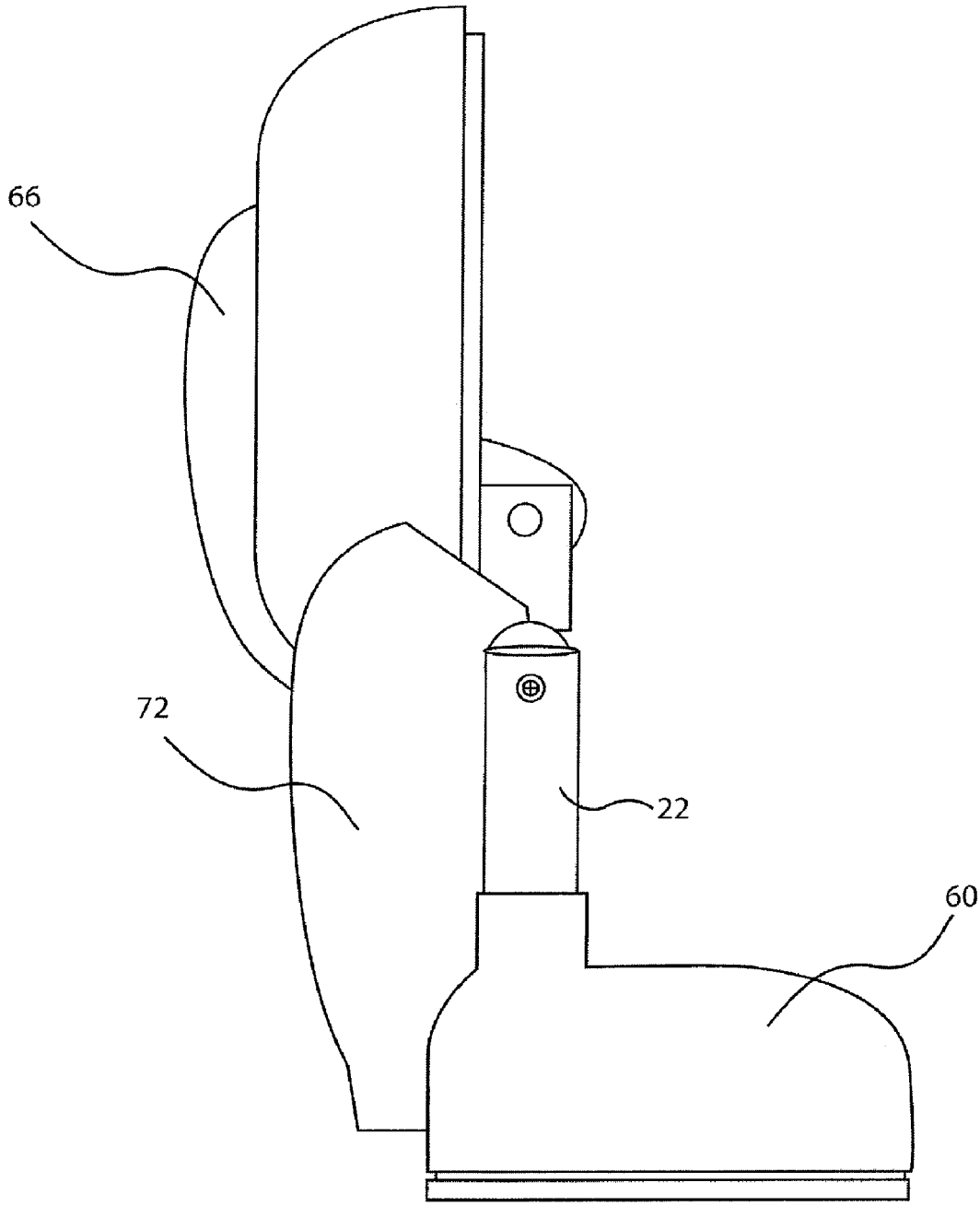
FIG. 2 is an internal side view illustrating the lower components of Elmo.

Now referring to FIG. 2, we see the lower internal structure of Elmo. Elmo 10 has specially shaped leg ribs 72 on the back of its legs 20, 22 to facilitate the wobbling, sitting and standing of Elmo 10 after Elmo has performed various actions. It also includes ribs 66 extending outwardly from the torso back which creates instability when Elmo 10 is lying on its back.

In FIG. 3, we see the teeter-totter linkage 48, consisting of spring contact cylinder 42, spherical center pivot 52, and ball ends 50, which transmits the action of the directly driven leg 20 to the spring driven leg 22. Central pivot 52, acts as a pivot in the horizontal axis to move the spring driven leg 22 in the opposite direction of the directly driven leg 20 against centering torsion spring 44 which is placed loosely on spring driven leg drive member 46 which is driven by and rotates with reversible motor mechanism 34. The active ends of the centering torsion spring 44 are in contact with spring contact cylinder 42 on connecting teeter-totter linkage 48 and an arm extending from right leg drive member 46. Spring driven leg 22 has a pin protruding inwardly through a slot in the right leg drive member 46 (not shown) to limit the spring driven leg 22 rotational movement in relation to spring driven leg drive member 46.

Referring now to FIGS. 4A-4F there is illustrated one of the sequences that Elmo 10 moves through to entertain a child. This sequence can be initiated by the optional foot switch 61 or by front activation switch 31 or by various other means such as a sound sensor.

Figure 4A:
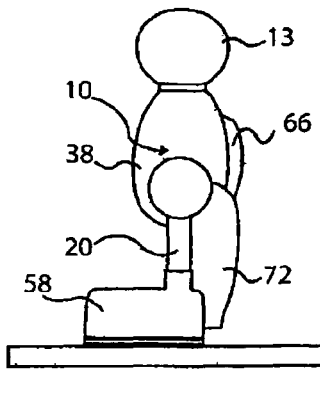
FIGS. 4A-4F are a sequence of views showing Elmo moving from the standing position to a sitting position.

In FIG. 4A we see Elmo 10 standing in an upright position.

Figure 4B:
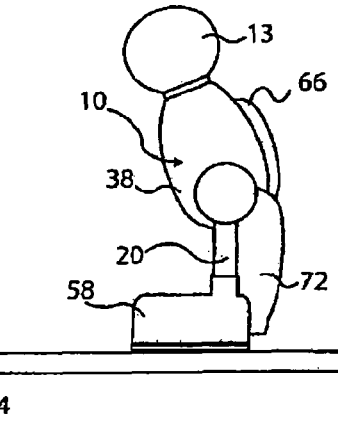

In FIG. 4B, the microprocessor controller 32 directs DC current to leg motor mechanism 34 which tilts the torso or housing 38 of Elmo 10 forward approximately 10 degrees.

Figure 4C:
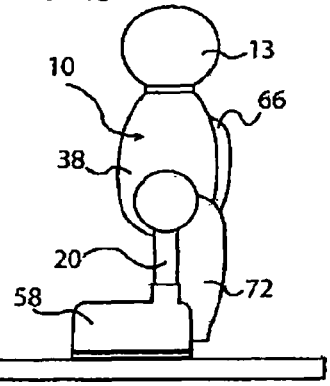

In FIG. 4C, the microprocessor 32 directs DC current to the leg motor mechanism 34 in the reverse polarity to move the torso 38 of Elmo 10 back to a somewhat straight up position perpendicular to the surface 64 on which Elmo 10 has been placed. This action is at a sufficient speed to cause instability in Elmo 10 to allow Elmo to wobble back and forth. This sequence of moves can continue or Elmo 10 can proceed to FIG. 4D.

Figure 4D:
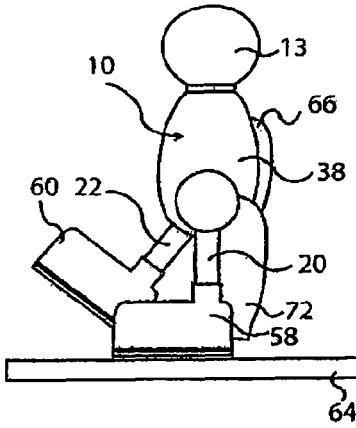

In FIG. 4D, the microprocessor motor controller 32 sends power to the motor mechanism 34 to move directly driven leg 20 to a position against the pivot stop 54 (see FIG. 3). Due to the teeter-totter action, the spring driven leg 22 moves under spring pressure in the opposite direction as the directly driven leg 20 although somewhat later than the direct driven leg 20. This causes an elevated instability and Elmo 10 moves towards a seated position as illustrated in FIGS. 4E and 4F.

Figure 4E:
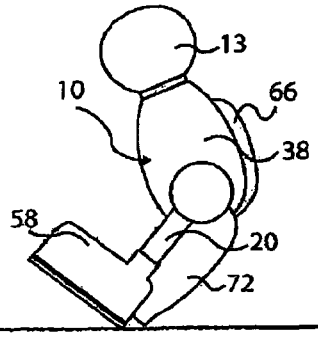

In FIG. 4E, the microprocessor motor controller 32 directs DC current to the leg motor mechanism 34 to lean Elmo 10 fully forward to compensate for the inertial forces of the sitting down action.

Figure 4F:
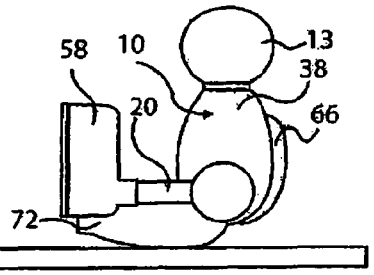

In FIG. 4F, we see Elmo 10 in a position where the stability has been established with the character resting on the leg ribs 72. The microprocessor motor controller 32 directs DC current to the leg motor mechanism 34 to move the torso 38 of Elmo 10 to a sitting up position, with the torso 38 approximately perpendicular to the surface.

Figure 4G:
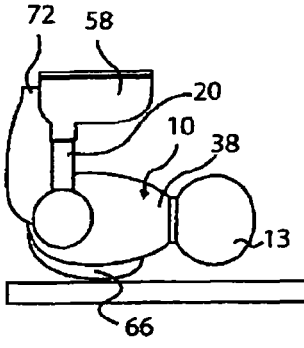
FIGS. 4G-4O illustrate a sequence of views wherein Elmo moves from a sitting position to a position where it is lying on its back.

In FIG. 4G, the microprocessor motor controller 32 directs power to the leg motor mechanism 34 to drive the legs away from the pivot stop 54 at sufficient speed to lift both feet while keeping the torso 38 on the ground. The ribs 72 on the back of Elmo 10 causes increased instability in this position.

Figure 4H:
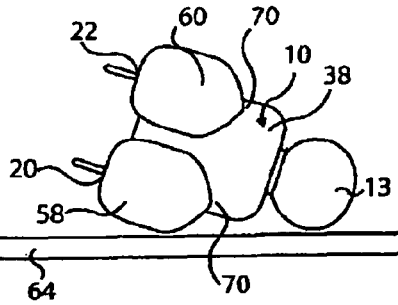

In FIG. 4H, the weight distribution of Elmo 10 in conjunction with the ribs 72 causes Elmo 10 to fall to its left side.

Figure 4I:
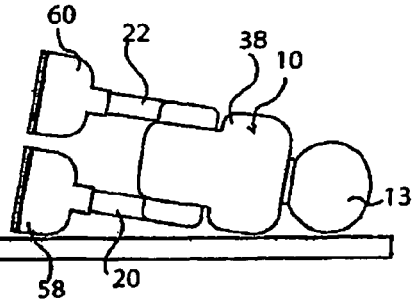

In FIG. 4I, the microprocessor motor controller 32 directs power to the leg motor mechanism 34 to drive the legs toward the pivot stop 54 until the legs 20, 22 of Elmo 10 are aligned with its torso 38.

Figure 4J:
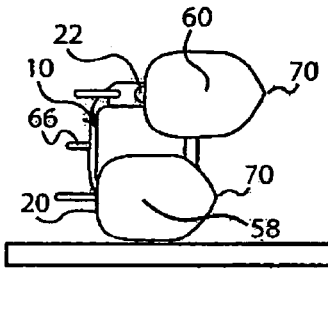

In FIG. 4J, the microprocessor motor controller 32 directs power to the leg motor mechanism 34 to drive the directly driven leg 20 against the pivot stop 54 which directs the spring loaded leg 22 in the opposite direction, this along with the weight distribution of character 10 increases instability in this position. The feet 58, 60 along with the shape of the torso 38 allows Elmo 10 to roll onto its stomach as seen in FIG. 4K.

Figure 4K:
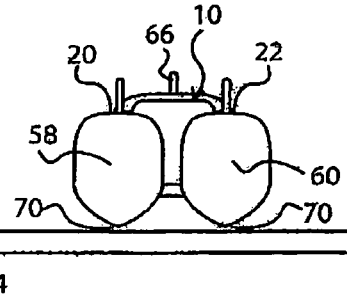

In FIG. 4K, Elmo 10 falls and rests onto a position facing the floor with the microprocessor motor controller 32 directing power to the leg motor mechanism 34.

Figure 4L:
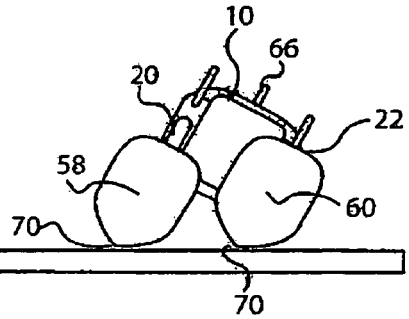

In FIG. 4L, the microprocessor motor controller 32 directs power to the leg motor mechanism 34 to drive the directly driven leg 20 away from the pivot stop 54. The spring loaded leg 22 has a slight lag in its movement causing character 10 to tilt to one side due to the weight of Elmo 10 applied against the spring tension.

Figure 4M:
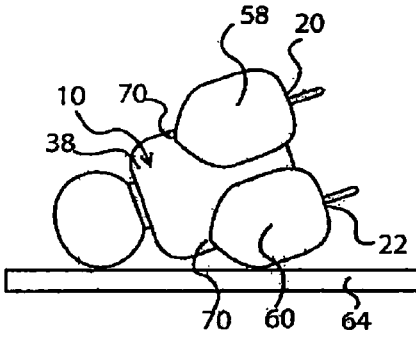

In FIG. 4M, the action from FIG. 4L is completed and the microprocessor motor controller 32 stops directing power to the leg motor mechanism when the legs are perpendicular to the torso of Elmo 10 which is now in a stable position.

Figure 4N:
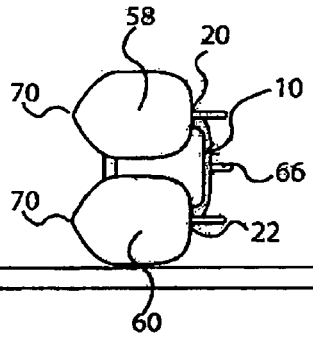

In FIG. 4N, the microprocessor motor controller 32 directs power to the leg motor mechanism 34 to bring the legs of Elmo 10 parallel to its torso. This is done at a sufficient speed to cause an increased amount of instability of Elmo 10 in this position.

Figure 4O:
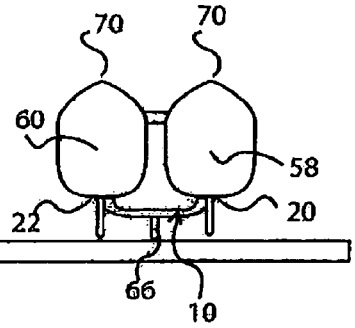

In FIG. 4O Elmo 10 falls onto its back to a stable position resulting from the actions performed in FIG. 4N along with the weight distribution of Elmo 10.

Figure 4P:
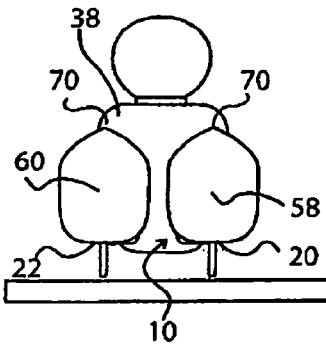

In FIG. 4P, the microprocessor motor controller 32 directs power to the leg motor mechanism 34 to bring the torso perpendicular to the ground at sufficient speed to allow Elmo 10 to remain stable in this position.

Figure 4Q:
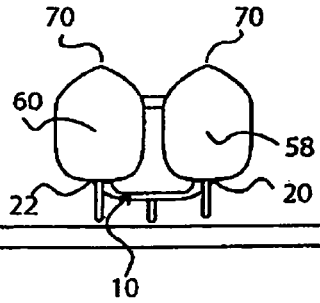
Figure 4R:
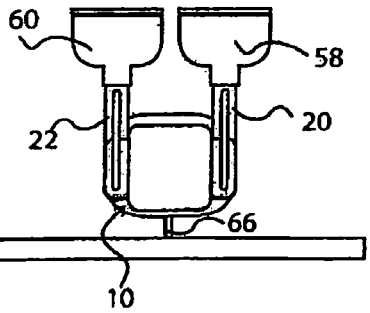

In FIG. 4Q, the microprocessor motor controller 32 directs power to the leg motor mechanism 34 towards the pivot stop 54 until the torso of character 10 is perpendicular to the legs which is done at a sufficient speed to allow the action to be completed as indicated in FIG. 4R.

In FIG. 4R, the microprocessor motor controller 32 directs power to the leg motor mechanism 34 to bring the legs perpendicular to the torso of character 10 which is done at a sufficient speed to cause Elmo 10 to fall onto its back allowing the torso to be parallel to the ground and the legs of Elmo 10 to be perpendicular with the ground. Due to the weight distribution, and the back ribs 72, Elmo 10 will not remain in this unstable position.

Figure 4S:
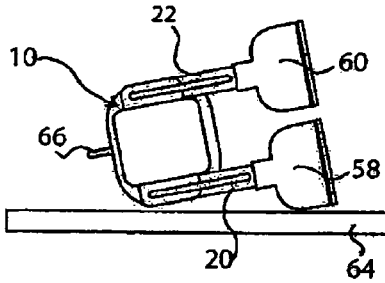

In FIG. 4S, Elmo 10 falls onto its side because of the actions performed in 4P, 4Q and 4R.

Figure 4T:
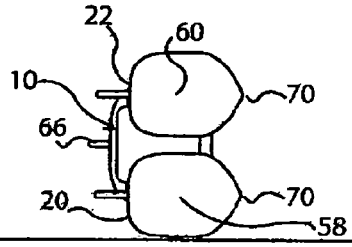

In FIG. 4T, the microprocessor motor controller 32 directs power to the leg motor mechanism 34 to move the legs of Elmo 10 into a position parallel to the torso.

Figure 4U:
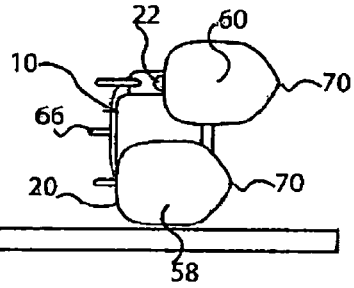
Figure 4V:
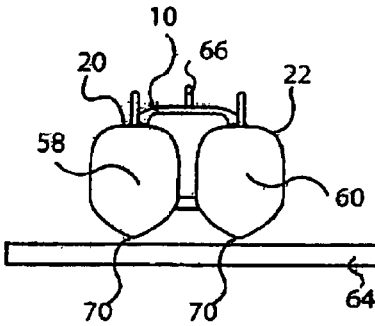

In FIG. 4U, the microprocessor motor controller 32 directs power to the leg motor mechanism 34 to move the directly driven leg 20 against the pivot stop 54 which directs the spring loaded leg 22 in the opposite direction, this along with the weight distribution of Elmo 10 increases instability in this position. The feet 58, 60 along with the shape of the toes 70 allow Elmo 10 to roll onto its stomach as seen in FIG. 4V. In FIG. 4V Elmo 10 falls and rests onto a position facing the floor with the microprocessor motor controller directing no power to the leg motor mechanism 34.

Figure 4W:
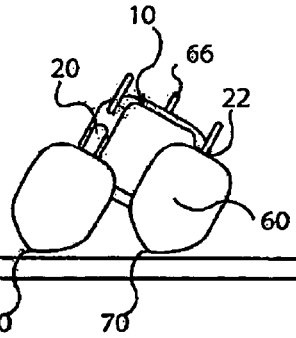

In FIG. 4W, the microprocessor motor controller 32 directs power to the leg motor mechanism 34 to drive the directly driven leg away from the pivot stop 54. The spring loaded leg 22 has a slight lag in its movement causing Elmo 10 to tilt to one side due to the weight of Elmo 10 applied against the spring tension.

Figure 4X:
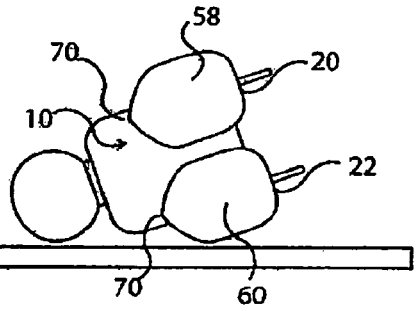

In FIG. 4X, the action from FIG. 4W is completed and the microprocessor motor controller 32 stops directing power to the leg motor mechanism when the legs are perpendicular to the torso of Elmo 10 which is now in a stable position.

Figure 4Y:
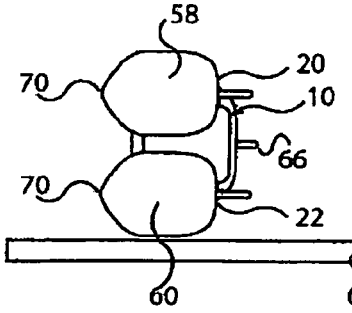

In FIG. 4Y, the microprocessor motor controller 32 directs power to the leg motor mechanism 34 to bring the legs of Elmo 10 parallel to its torso. This is done at a sufficient speed to cause an increased amount of instability of Elmo 10 in this position.

Figure 4Z:
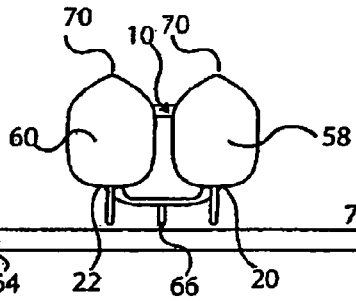
Figure 4A:
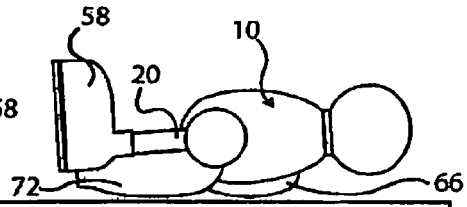
Figure 4B:
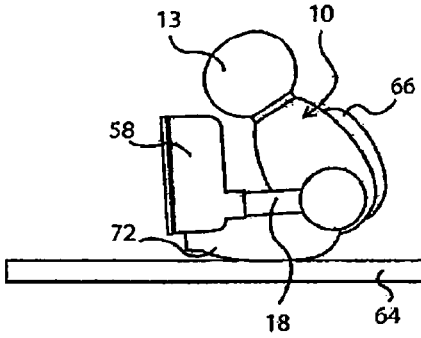
Figure 4C:
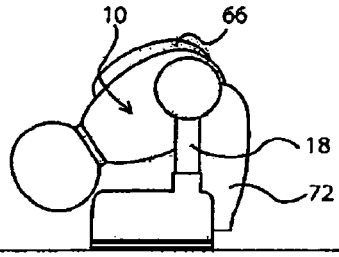
Figure 4D:
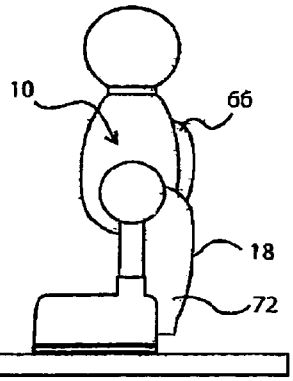

In FIG. 4Z Elmo 10 falls onto its back to a stable position resulting from the actions performed in FIG. 4Y.

In FIG. 4AA, the view of Elmo 10 is rotated 90 degrees along the vertical.

In FIG. 4BB, the microprocessor motor controller 32 activates the leg motor mechanism 34 to move the torso of Elmo 10 backwards and quickly forward to rock Elmo 10 forward on specially shaped leg ribs 72.

In FIG. 4CC, the microprocessor motor controller 32 directs power to the leg motor mechanism 34 to move the torso of Elmo 10 to a position approximately 90 degrees to the legs 22 and 20. This position working in conjunction with the weight of the batteries 56 creates a stable base for the Elmo 10.

In FIG. 4DD, the microprocessor motor controller 32 directs power to the leg motor mechanism 34 to move the torso of Elmo 10 to an upright position.

This completes the description of the Elmo character 10 and the sequence of motions effected by the motor controller 32.

We now turn to FIGS. 5, 6A, 6B and 7A through U which deal with the second toy plush character 11 referred to as Cookie.

Figure 5:
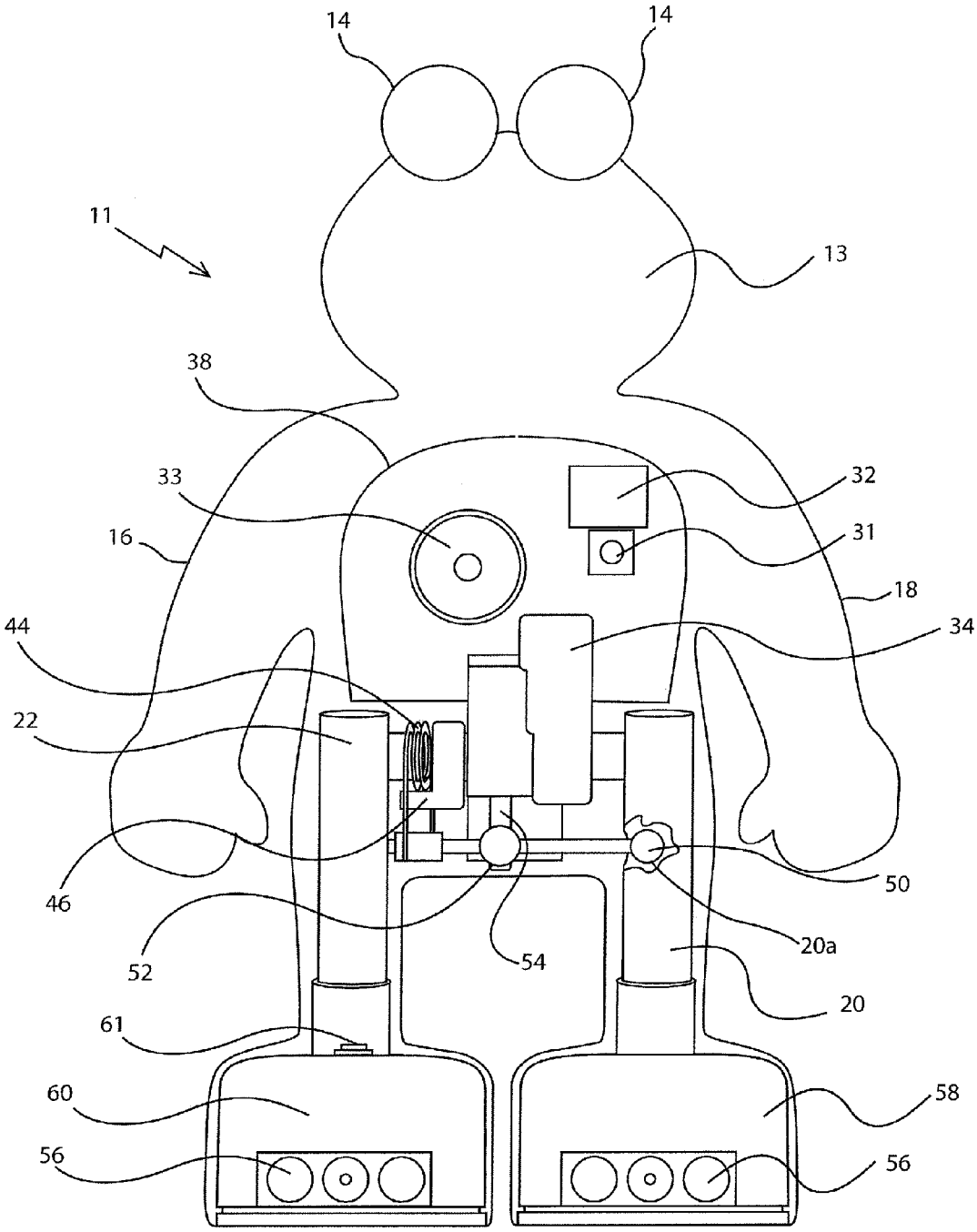
FIG. 5 is a cross-sectional view showing the internal components of a second toy plush character which for ease of description will be referred to as Cookie.

FIG. 5 is a front cross-sectional view showing the internal components of the plush Cookie 11. This view of Cookie 11 is identical to FIG. 1 illustrating the internal components of Elmo 10 and reference is thus made to the earlier discussion thereof which are identified with the same numbers.

Figure 6A:
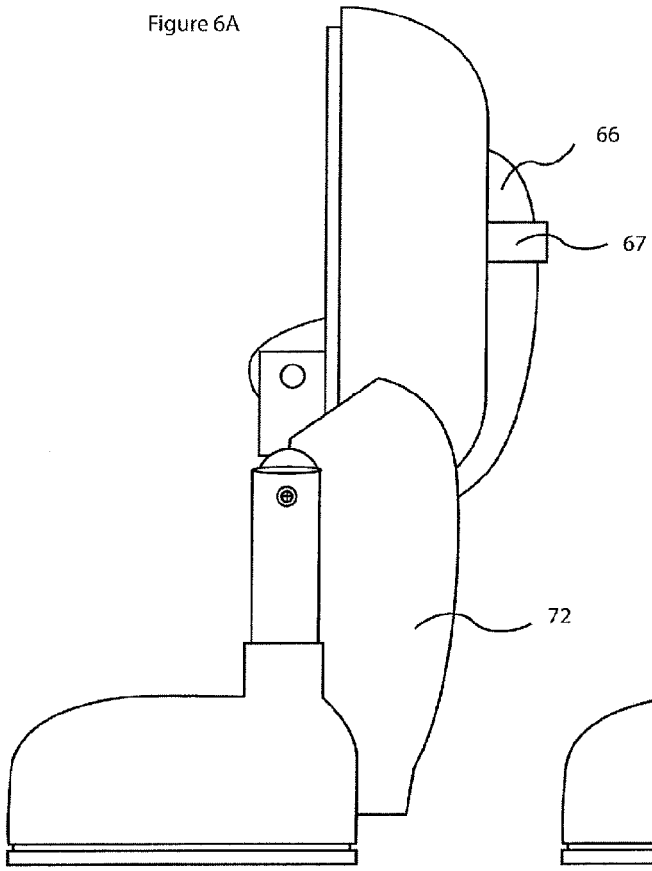
FIGS. 6A-6B are internal side views illustrating two embodiments of the lower components of Cookie.
Figure 6B:
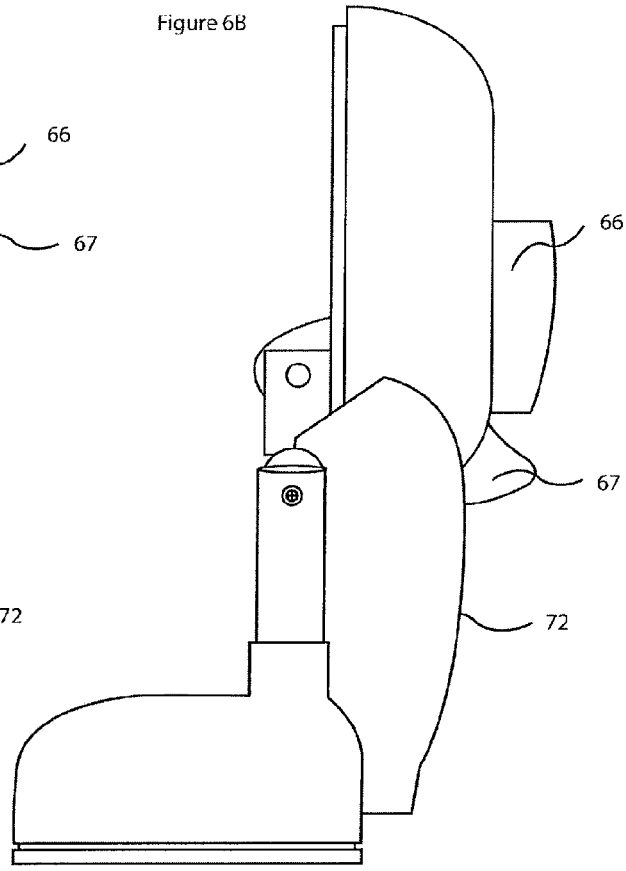

Referring now to FIGS. 6A-6B, while similar in some respects to FIG. 2, differs in that it includes the member 67 located on the back of Cookie 11 to bring about a different sequence of movements to be described when discussing FIGS. 7A-7U below. Both members 66 and 67 can be shaped in the combinations either illustrated in FIG. 6A or 6B to accomplish the same resultant movement as illustrated in FIGS. 7A-7U. For ease of explanation, the illustrated FIGS. 7A-7U will resemble the illustration in FIG. 6A.

Referring now to FIGS. 7A-7F there is illustrated one of the sequences that Cookie 11 moves through to entertain a child. This sequence can be initiated by the foot switch 61 or by front activation switch 31 or by various other means such as a sound sensor.

In FIG. 7A we see Cookie 11 standing in an upright position.

In FIG. 7B, the microprocessor controller 32 directs DC current to leg motor mechanism 34 which tilts the torso or housing 38 of Cookie 11 forward approximately 10 degrees.

In FIG. 7C, the microprocessor 32 directs DC current to the leg motor mechanism 34 in the reverse polarity to move the torso 38 of Cookie 11 back to a somewhat straight up position perpendicular to the surface 64 on which Cookie 11 has been placed. This action is at a sufficient speed to cause instability in Cookie 11 to allow Cookie 11 to wobble back and forth. This sequence of moves can continue or Cookie 11 can proceed to FIG. 7D.

In FIG. 7D, the microprocessor motor controller 32 sends power to the motor mechanism 34 to move directly driven leg 20 to a position against the pivot stop 54 (see FIG. 3). Due to the teeter-totter action, the spring driven leg 22 moves under spring pressure in the opposite direction as the directly driven leg 20 although somewhat later than the direct driven leg 20. This causes an elevated instability and Cookie 11 moves towards a seated position as illustrated in FIG. 7E.

In FIG. 7E, the microprocessor motor controller 32 directs DC current to the leg motor mechanism 34 to lean Cookie 11 fully forward to compensate for the inertial forces of the sitting down action.

In FIG. 7F, we see Cookie 11 in a position where the stability has been established with the character resting on the leg ribs 72. The microprocessor motor controller 32 directs DC current to the leg motor mechanism 34 to move the torso of Cookie 11 to a sitting up position, with the torso approximately perpendicular to the surface 64.

In FIG. 7G, the microprocessor motor controller 32 directs power to the leg motor mechanism 34 to lean Cookie 11 forward approximately 10 degrees from the sitting position.

In FIG. 7H, the microprocessor motor controller 32 reverses the power to the leg motor mechanism 34 to lay Cookie 11 parallel to the surface of the ground 64.

In FIG. 7I, the microprocessor motor controller 32 reverses the power to the leg motor mechanism 34 resulting in the directly driven leg 20 and the spring loaded leg 22 to be raised perpendicular to the torso 38 and the ground 64. This action is at a sufficient speed that allows the legs to lift off the ground 64 instead of the torso 38.

Figure 7J:
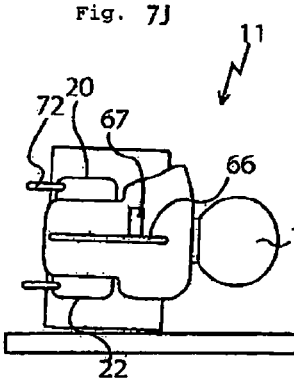

In FIG. 7J, the action described in FIG. 7I increases instability in Cookie 11. The rib 66 along the back 39 of Cookie 11 also creates more instability in this position. The limiting piece 67 along the rib 66 increases the resistance on the left side of Cookie 11 while its legs 20, 22 are perpendicular to the torso 38. This forces Cookie 11 to fall to the right side.

Figure 7K:
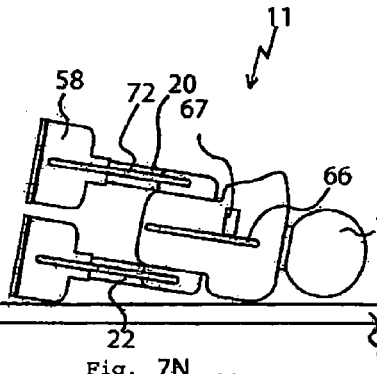

In FIG. 7K, the microprocessor 32 directs power to the leg motor mechanism 34 that allows the legs 20, 22 to align with the torso 38. This action is done at a sufficient speed that causes Cookie 11 to be unstable in this position.

Figure 7L:
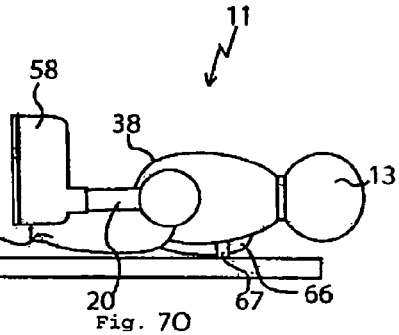

In FIG. 7L, the action performed in FIG. 7K forces Cookie 11 to fall to a stable position on its back rib 66. Cookie 11 is then parallel with the ground.

Figure 7M:
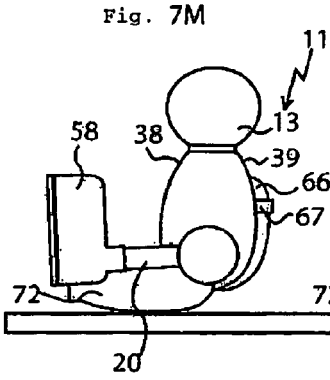

In FIG. 7M, the microprocessor directs power to the leg motor mechanism 34 that allows the torso 38 to rise and remain in a stable perpendicular position to the ground 64 which is done at a sufficient speed that allows the torso 38 of Cookie 11 to rise and not its feet.

Figure 7N:
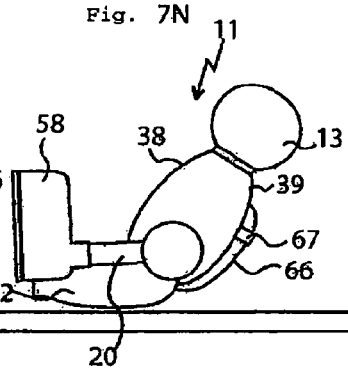
FIGS. 7N-7U are a sequence of views moving Cookie back and around to a supine position and then back to a standing position.

In FIG. 7N the microprocessor directs power to the leg motor mechanism 34 that moves the torso approximately 25 degrees from the perpendicular which creates an instability in Cookie 11.

Figure 7O:
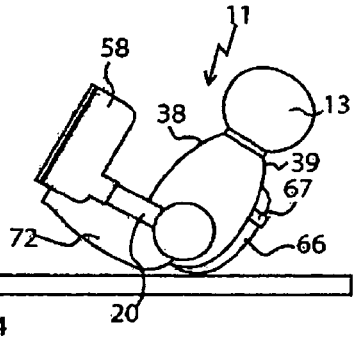

In FIG. 7O, the microprocessor reverses the DC current to the leg motor mechanism 34 to move the directly driven leg 20 and the spring loaded leg 22 to a perpendicular position with the torso 38. This action is done at a sufficient speed that the feet 58, 60 lift off the ground and the torso 38 remains in its current position.

Figure 7P:
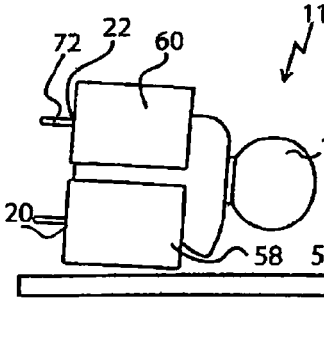

In FIG. 7P, the weight distribution in Cookie 11 forces the character to fall to its left side.

Figure 7Q:
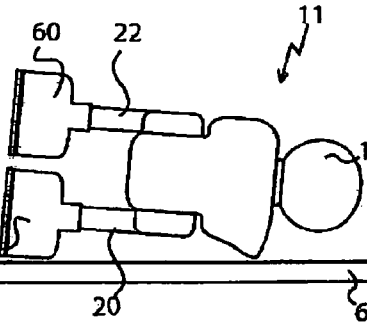

In FIG. 7Q, the microprocessor directs power to the leg motor mechanism 34 that allows the legs 20, 22 to align with the torso 38. This action is done at a sufficient speed to cause Cookie 11 to be unstable in this position.

Figure 7R:
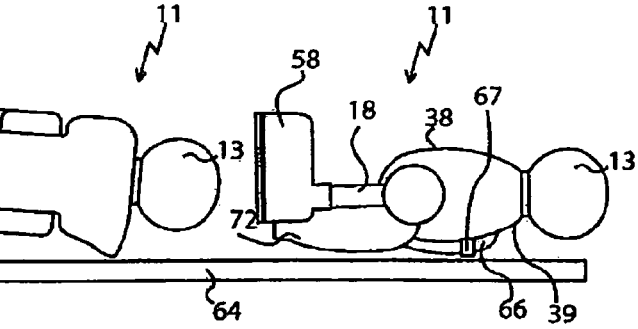

In FIG. 7R, the action performed in FIG. 7Q forces Cookie 11 to fall to a stable position on its back 39. Cookie 11 is then parallel with the ground.

Figure 7S:
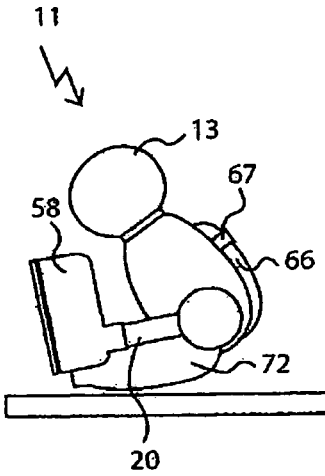

In FIG. 7S, the microprocessor motor controller 32 activates the leg motor mechanism 34 to move the torso of Cookie 11 backwards and quickly forward to rock Cookie 11 forward on specially shaped leg ribs 72.

Figure 7T:
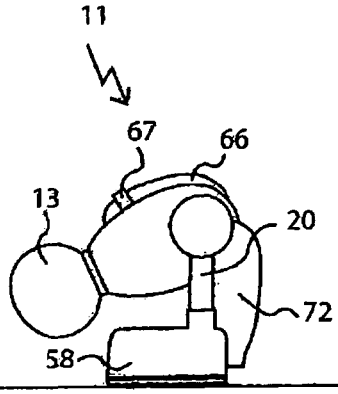
Figure 7U:
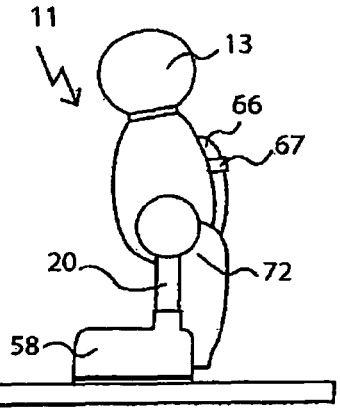

In FIG. 7T, the microprocessor motor controller 32 directs power to the leg motor mechanism 34 to move the torso 38 of Cookie 11 to a position approximately 90 degrees to the legs 22 and 20. This position working in conjunction with the weight of the batteries 56 create a stable base for Cookie 11.

In FIG. 7U, the microprocessor motor controller 32 directs power to the leg motor mechanism 34 to move the torso 38 of Cookie 11 to an upright position.

We now turn to FIGS. 8, 9 and 10A through 10BB which deal with the third toy plush character 12 referred to as Ernie.

Figure 8:
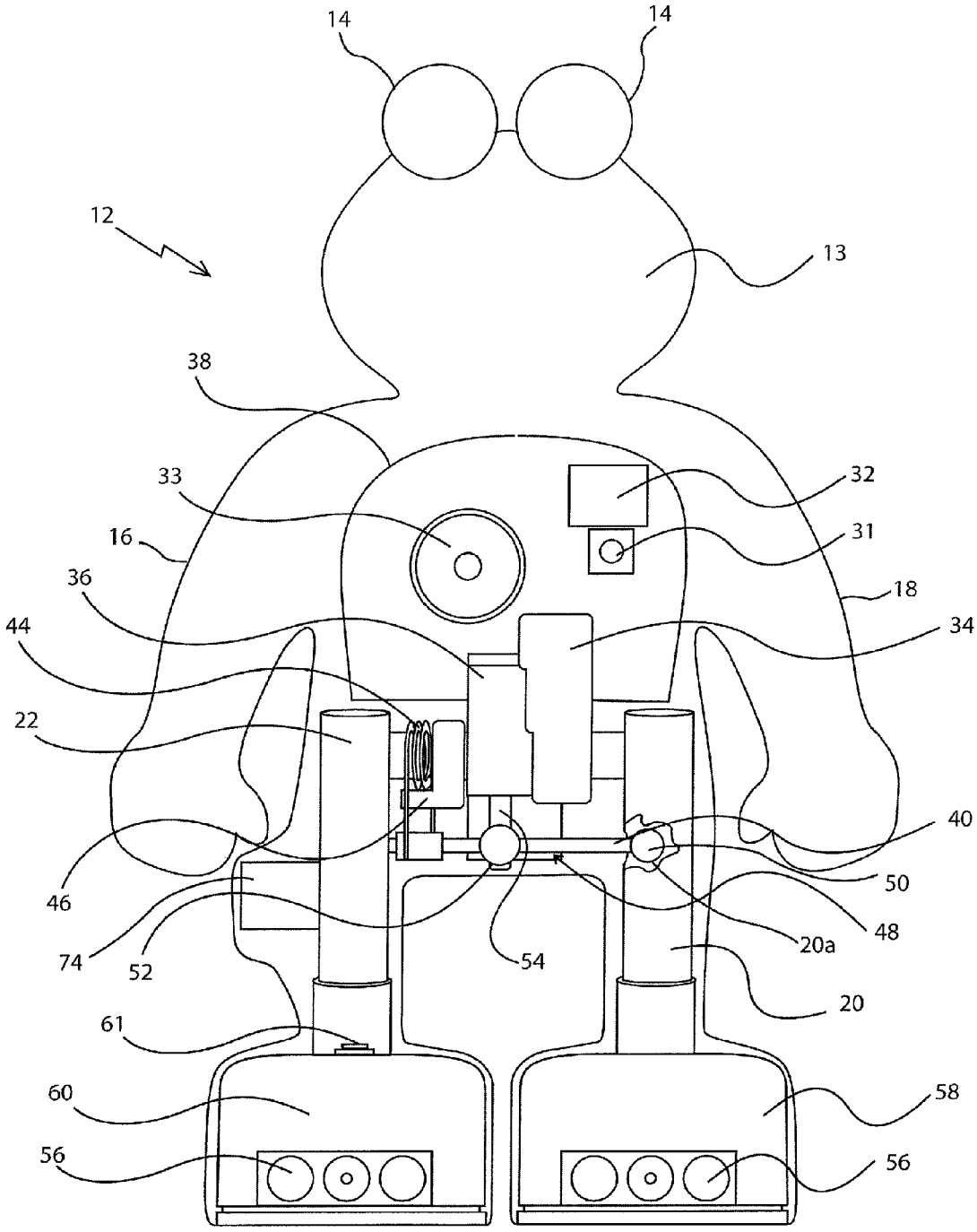
FIG. 8 is a cross-sectional view showing the internal components of a third toy plush character which for ease of description will be referred to as Ernie.

FIG. 8 is a front cross-sectional view showing the internal components of the Ernie plush character 12. This view of Ernie is very similar to FIG. 1 illustrating the internal components of Elmo and reference is thus made to the earlier discussion thereof which are identified with the same numbers. It differs in that it includes a block member 74 secured to the spring driven leg 22 to bring about a different sequence of movements than those accomplished by Elmo and Cookie.

Figure 9A:
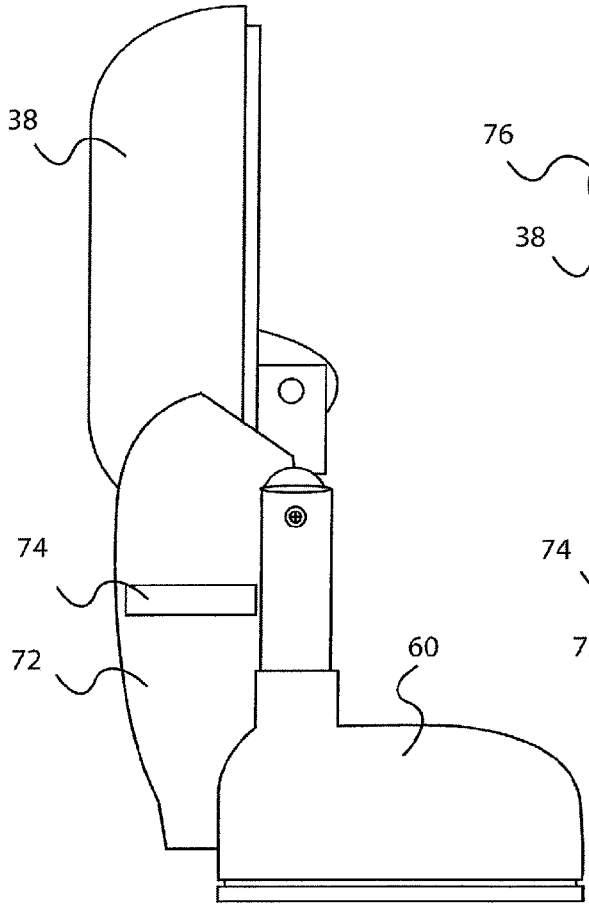
FIGS. 9A-9B are internal side views illustrating two embodiments of the lower components of Ernie.
Figure 9B:
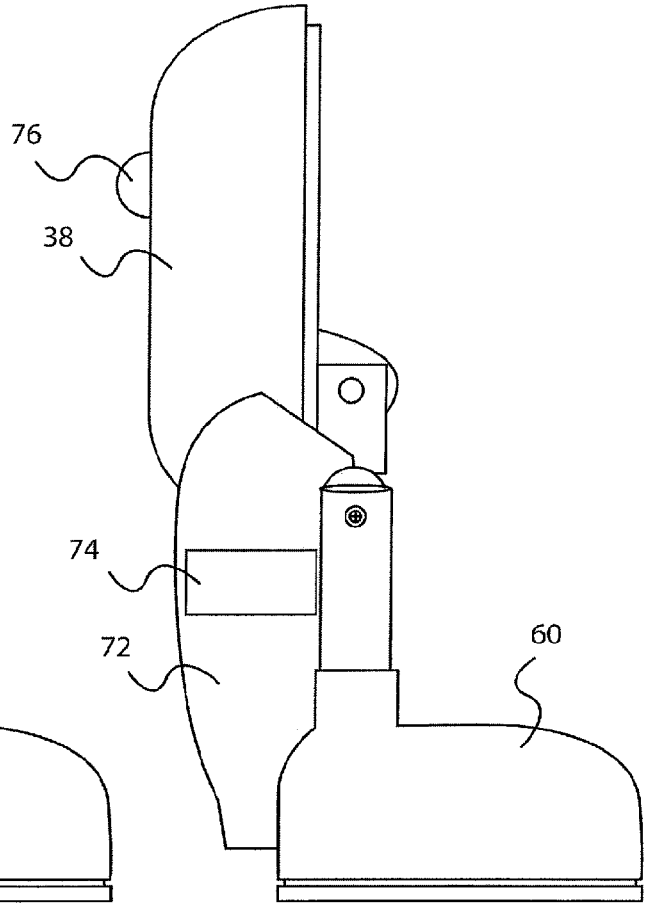

In FIGS. 9A-9B while similar in some respects to FIG. 2, differs in that it does not include the rib 66 on the back of the torso 38. Both the combination of the spherical block 76 and the block member 74 in FIG. 9B and the single block member 74 in FIG. 9A will accomplish the same resultant movement as illustrated in FIGS. 10A-10BB.

In FIG. 10A we see Ernie 12 standing in an upright position.

Figure 10J:
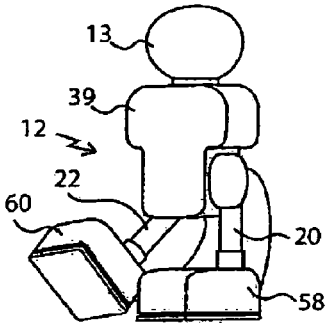
Figure 10K:
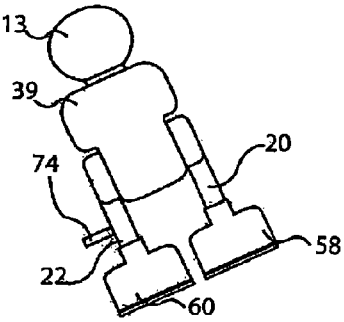
Figure 10L:
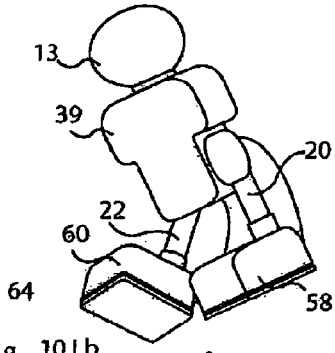
FIGS. 10L-10Ob are a sequence of views during which the body portion moves to various positions and Ernie is rotated parallel to the ground a total of approximately 50 degrees.
Figure 10J:
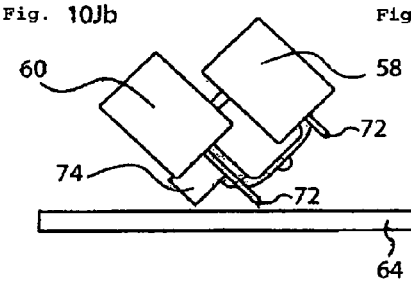
Figure 10K:
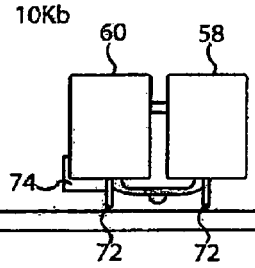
Figure 10:
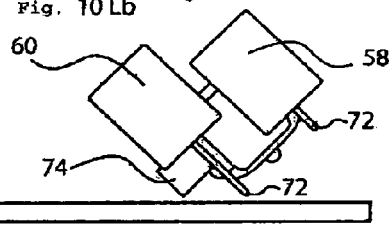
Figure 10M:
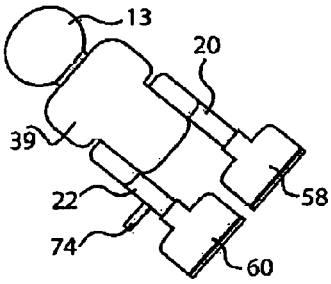
Figure 10N:
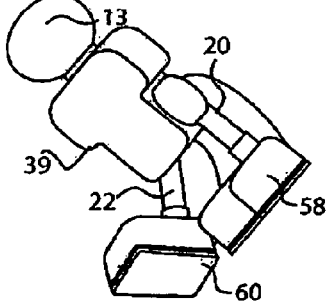
Figure 10O:
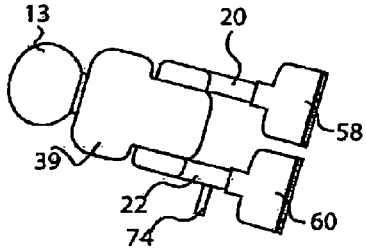
Figure 10M:
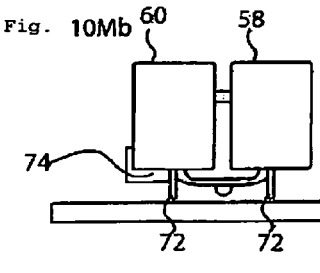
Figure 10N:
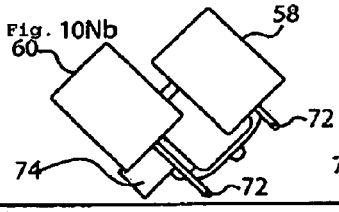
Figure 10B:
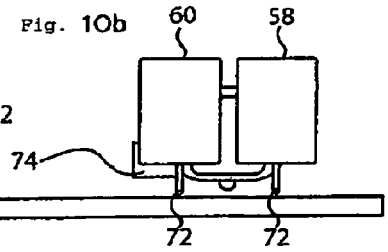

In FIG. 10B, the microprocessor controller 32 directs DC current to leg motor mechanism 34 which tilts the torso or housing 38 of Ernie 12 forward approximately 10 degrees.

In FIG. 10C, the microprocessor 32 directs DC current to the leg motor mechanism 34 in the reverse polarity to move the torso 38 of Ernie 12 back to a somewhat straight up position perpendicular to the surface 64 on which Ernie 12 has been placed. This action is at a sufficient speed to cause instability in Ernie 12 to allow Ernie 12 to wobble back and forth. This sequence of moves can continue or Ernie 12 can proceed to FIG. 10D.

In FIG. 10D, the microprocessor motor controller 32 sends power to the motor mechanism 34 to move directly driven leg 20 to a position away from the pivot stop 54 (see FIG. 3). The spring driven leg 22 moves under spring pressure in the same direction as the directly driven leg 20 although somewhat later than the direct driven leg 20. This causes an elevated instability and Ernie 12 moves towards a seated position as illustrated in FIG. 10E.

In FIG. 10E, the microprocessor motor controller 32 directs DC current to the leg motor mechanism 34 to lean Ernie 12 fully forward to compensate for the inertial forces of the sitting down action.

In FIG. 10F, we see Ernie 12 in a position where the stability has been established with the character resting on the leg ribs 72. The microprocessor motor controller 32 directs DC current to the leg motor mechanism 34 to move the torso of Ernie 12 to a sitting up position, with the torso approximately perpendicular to the surface 64.

In FIG. 10G, the microprocessor controller 32 is operated to move the torso to a prone position.

FIG. 10H is a front view facing the feet of Ernie 12 in FIG. 10G.

In FIG. 10I, the microprocessor controller 32 directs power to the leg motor mechanism 34 to bring the directly driven leg 20 against the pivot stop 54 and through the teeter-totter action the spring driven leg 22 moves under spring pressure in the opposite direction as the directly driven leg 20. This causes the spring driven leg 22 to move off of the ground to approximately 20 degrees from the horizontal.

FIG. 10Ja is a top view of FIG. 10Jb wherein Ernie 12 is located approximately 90 degrees from the horizontal.

In FIG. 10Jb, Ernie 12 is leaned to one side because of the action caused in FIG. 10I and the block member 74 then becomes the main pivot point of Ernie 12 while in this position.

In FIG. 10Ka, which is a top view of FIG. 10Kb, Ernie 12 is approximately 90 degrees from the horizontal.

In FIG. 10Kb the microprocessor motor controller 12 directs power to the leg motor mechanism 34 to bring the directly driven leg 20 away from the pivot stop 54, this causes Ernie 12 to fall back parallel to the ground. This is done at a sufficient speed that allows the block member 74 to push the side of Ernie 12 slightly. This causes Ernie 12 to rotate parallel to the ground approximately 25 degrees.

In FIG. 10La, which is the top view of FIG. 10Lb, Ernie 12 is approximately 115 degrees from the horizontal.

In FIG. 10Lb the microprocessor motor controller 32 directs the power to the leg motor mechanism 34 to bring the directly driven leg 20 against the pivot stop 54. The spring driven leg moves under spring pressure in the opposite direction as the directly driven leg 20. This causes the spring driven leg 22 to move off the ground approximately 20 degrees from the horizontal.

In FIG. 10Ma, which is the top view of FIG. 10Mb, Ernie 12 is approximately 115 degrees from the horizontal.

In FIG. 10Mb the microprocessor controller motor 32 directs power to the leg motor mechanism 34 to bring the directly driven leg 20 away from the pivot stop 54. This causes Ernie 12 to fall back parallel to the ground. This is done at a sufficient speed that allows the block 74 to push the side of the character slightly. This causes the character to rotate parallel to the ground approximately 25 degrees.

In FIG. 10Na there is shown a top figure of 10Nb, wherein Ernie 12 is approximately 140 degrees from the horizontal.

In FIG. 10Nb the microprocessor motor controller 32 directs power to the leg motor mechanism 34 to bring the directly driven leg 20 against the pivot stop 54. The spring driven leg 22 moves under spring pressure in the opposite direction as the directly driven leg 20. This causes the spring driven leg 22 to move off the ground approximately 20 degrees from the horizontal.

FIG. 10Oa is a top view of FIG. 10Ob, wherein Ernie 12 is approximately 140 degrees from the horizontal.

In FIG. 10Ob the microprocessor motor controller 32 directs power to the leg motor mechanism 34 to bring the directly driven leg 20 away from the pivot stop 54. This causes Ernie 12 to fall back parallel to the ground. This is done at a sufficient speed that allows the block 74 to push the side of the character slightly. This causes the character to rotate parallel to the ground approximately 25 degrees.

Figure 10P:
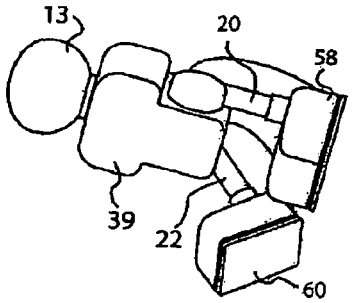
FIGS. 10Pa-10Tb are a sequence of views wherein the body and leg portions are moved through various positions and the toy character is rotated parallel to the ground a total of approximately 50 degrees.

FIG. 10Pa is a top view of FIG. 10Pb wherein Ernie 12 is approximately 165 degrees from the horizontal.

In FIG. 10Pb the microprocessor motor controller 32 directs the power to the leg motor mechanism 34 to bring the directly driven leg 20 against the pivot stop 54. The spring driven leg 22 moves under spring pressure in the opposite direction as the directly driven leg 20. This causes the spring leg 22 to move off the ground approximately 20 degrees from the horizontal.

Figure 10Q:
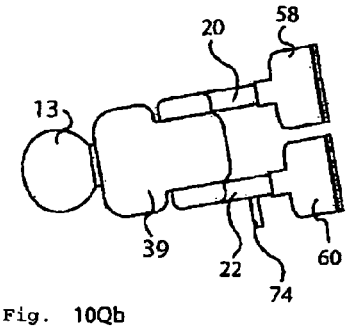

FIG. 10Qa is a top view of FIG. 10Qb wherein Ernie 12 is approximately 165 degrees from the horizontal.

In FIG. 10Qb the microprocessor motor controller 32 directs the power to the leg motor mechanism 34 to bring the directly driven leg 20 away from pivot stop 54. This causes Ernie 12 to fall back parallel to the ground. This is done at a sufficient speed to allow the block 74 to push the side of the character slightly. This causes the character to rotate parallel to the ground approximately 25 degrees.

Figure 10R:
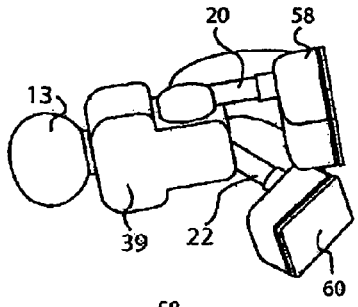
Figure 10P:
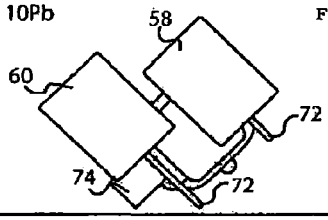
Figure 10Q:
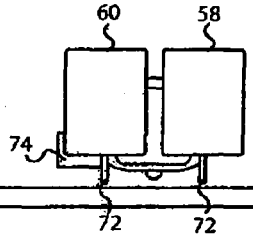
Figure 10R:
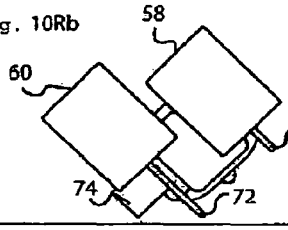

FIG. 10Ra is a top figure of 10Rb wherein Ernie 12 is approximately 190 degrees from the horizontal.

In FIG. 10Rb the microprocessor motor controller 32 directs power to the leg motor mechanism 34 to bring the directly driven leg 20 against the pivot stop 54. The spring driven leg 22 moves under spring pressure in the opposite direction as the directly driven leg 20. This causes the spring driven leg 22 to move off the ground approximately 20 degrees from the horizontal.

Figure 10S:
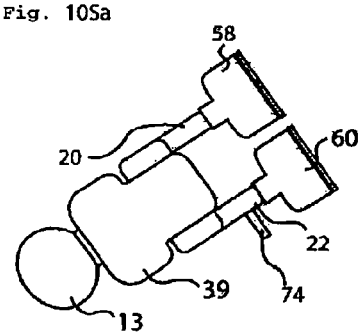

FIG. 10Sa is a top view of FIG. 10Sb wherein Ernie 12 is approximately 190 degrees from the horizontal.

In FIG. 10Sb the microprocessor motor controller 32 directs the power to the leg motor mechanism 34 to bring the directly driven leg 19 away from the pivot stop 54. This causes Ernie 12 to fall back parallel to the ground. This is done at a sufficient speed that allows the block 74 to push the side of the character slightly. This causes Ernie 12 to rotate parallel to the ground approximately 25 degrees.

Figure 10T:
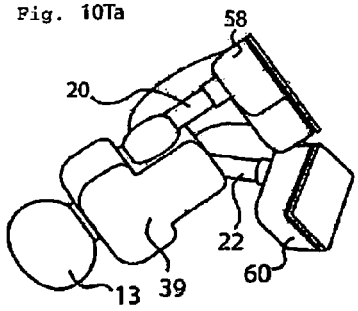

FIG. 10Ta is a top view of FIG. 10Tb wherein Ernie 12 is approximately 215 degrees from the horizontal.

In FIG. 10Tb the microprocessor motor controller 32 directs power to the leg motor mechanism 34 to bring the directly driven leg 20 against the pivot stop 54. The spring driven leg 22 moves under spring pressure in the opposite direction as the directly driven leg 20. This causes the spring driven leg 22 to move off the ground approximately 20 degrees from the horizontal.

Figure 10U:
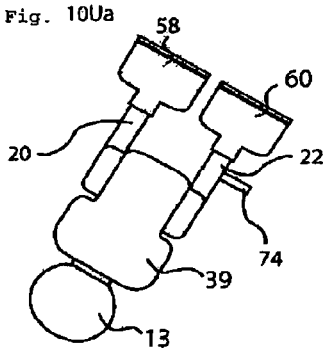
Figure 10S:
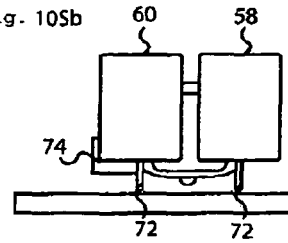
Figure 10T:
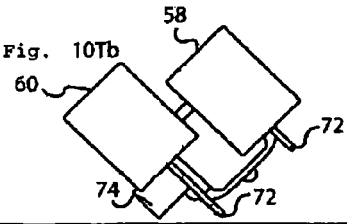
Figure 10U:
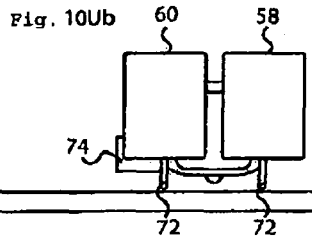
Figure 10U:
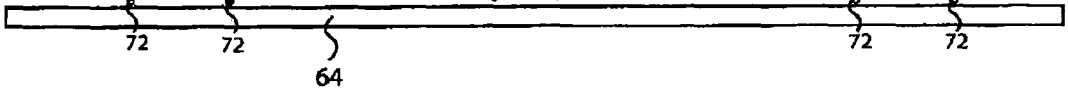

FIG. 10Ua is a top view of FIG. 10Vb wherein Ernie 12 is approximately 215 degrees from the horizontal.

In FIGS. 10Ub the microprocessor motor controller 32 directs power to the leg motor mechanism 34 to bring the directly driven leg 20 away from the pivot stop 54. This causes Ernie 12 to fall back parallel to the ground. This is done at a sufficient speed that allows the block 74 to push the side of the character slightly. This causes Ernie 12 to rotate parallel to the ground approximately 25 degrees.

FIG. 10Va is a top view of FIG. 10Vb wherein Ernie 12 is approximately 240 degrees from the horizontal.

In FIG. 10Vb the microprocessor motor controller 32 directs power to the leg motor mechanism 34 to bring the directly driven leg 20 against the pivot stop 54. The spring driven leg 22 moves under spring pressure in the opposite direction as the directly driven leg 20. This causes the spring driven leg 22 to move off the ground approximately 20 degrees from the horizontal.

FIG. 10Wa is a top view of FIG. 10Wb wherein Ernie 12 is approximately 240 degrees from the horizontal.

In FIG. 10Wb the microprocessor motor controller 32 directs power to the leg motor mechanism 34 to bring the directly driven leg 20 away from the pivot stop 54. This causes Ernie 12 to fall back parallel to the ground. This is done at a sufficient speed to allow the block 74 to push the side of the character slightly. This causes the character to rotate parallel to the ground approximately 25 degrees.

FIG. 10Xa is a top view of FIG. 10Xb wherein Ernie 12 is approximately 265 degrees from the horizontal.

In FIG. 10Xb the microprocessor motor controller 32 directs power to the leg motor mechanism 34 to bring the directly driven leg 20 against the pivot stop 54. The spring driven leg 22 moves under spring pressure in the opposite direction as the directly driven leg 20. This causes the spring driven leg 22 to move off the ground approximately 20 degrees from the horizontal.

In FIG. 10Y the action performed in FIG. 10Xb forces Ernie 12 to fall to a stable position on its back. Ernie 12 is then parallel with the ground.

In FIG. 10Z the microprocessor motor controller 32 activates the leg motor mechanism 34 to move the torso 38 of Ernie 12 backwards and quickly forward to rock Ernie 12 forward on specially shaped leg ribs 72.

In FIG. 10AA the microprocessor motor controller 32 directs power to the leg motor mechanism 34 to move the torso 38 of Ernie 12 to a position approximately 90 degrees to the legs 22 and 20. This position working in conjunction with the weight of the batteries 56 creates a stable base for Ernie 12.

In FIG. 10BB the microprocessor motor controller 32 directs power to the leg motor mechanism 34 to move the torso 38 of Ernie 12 to an upright position.

It is intended to cover by the appended all modifications and embodiments that fall within the true spirit and scope of the invention.

The invention claimed is:

1. A toy character assembly comprising: a body portion, first and second leg assemblies including leg portions movably connected to said body portion, a bidirectional motor means for moving a first leg assembly and body portion relative to each other, a rib means secured to a back of each leg assembly for facilitating the sitting, standing and moving of said toy character assembly when the body and leg portions are moved by said motor means, interconnecting said first and second leg assemblies for moving said second leg assembly by said first leg assembly including a rod assembly, a spring having one end in engagement with said rod and its other end connected to a drive mechanism for said second leg whereby upon movement of the first leg in one direction said rod will act against said spring to move said drive member to move the second leg in the same direction, the rod is part of a teeter-totter mechanism that includes a central pivot in contact with a pivot stop secured to said body portion and the rod ends are located in said first and second leg assemblies whereby when the first leg is moved in the opposite direction the central pivot will contact said pivot stop to move the second leg in the opposite direction from said first leg, a microprocessor for controlling the operation of said motor, means to obtain the desired sequence of events for said motor mechanism and arm and leg assemblies, power means for operating said microprocessor and switch means for activating said microprocessor.

2. A toy character assembly as set forth in claim 1 in which the body portion includes a back rib secured thereto for facilitating the movement of the toy character when it is lying on its back as determined by said microprocessor.

3. A toy character assembly as set forth in claim 2 in which there is a limiting piece secured to said back adjacent said back rib for facilitating the movement of the toy character when lying on its back as determined by said microprocessor.

4. A toy character assembly as set forth in claim 1 in which there is a block member secured to one of the rib means located on the back of one of said leg assemblies for facilitating the movement of said toy character when said rib means are used for supporting the toy character assembly as determined by said microprocessor.

* * * * *